United States Patent [19]

Silva

[11] 4,304,432

[45] Dec. 8, 1981

[54] PLATE-LIFTING DEVICE

[75] Inventor: Fred D. Silva, San Lorenzo, Calif.

[73] Assignee: Cavaz, Hanlon & Silva, San Leandro, Calif.

[21] Appl. No.: 128,669

[22] Filed: Mar. 10, 1980

[51] Int. Cl.[3] ..... B66C 1/66

[52] U.S. Cl. ..... 294/93; 294/89

[58] Field of Search ..... 294/15, 16, 13, 27 R, 294/62, 82 R, 83 R, 86 R, 81 SF, 86.24, 86.25, 89, 92, 93–97; 52/125, 707; 410/101–116

[56] References Cited

U.S. PATENT DOCUMENTS

| | | | |
|---|---|---|---|
| 201,409 | 3/1878 | Graham et al. | 294/89 |
| 764,281 | 7/1904 | Duncan | 294/89 |
| 981,365 | 1/1911 | Birnie et al. | 294/89 |
| 2,422,693 | 6/1947 | McArthur | 410/116 |
| 2,563,164 | 8/1951 | Fletcher | 294/89 |
| 2,719,747 | 10/1955 | Layne | 294/89 |
| 2,786,428 | 3/1957 | Arnold | 410/102 |
| 3,282,229 | 11/1966 | Elsner | 410/105 |
| 3,617,085 | 11/1971 | Modrey | 294/93 X |

*Primary Examiner*—Johnny D. Cherry

*Attorney, Agent, or Firm*—Manfred M. Warren; Robert B. Chickering; Glen R. Gruenwald

[57] ABSTRACT

A device for lifting a cover plate, the cover plate having a hole therein with opposed beveled surfaces, preferably at the center of gravity of the plate, which device includes a lifting element having an eye extended above laterally expanded, beveled portions, the beveled portions being slightly shallower than the thickness of the plate and of dimensions adapted to correspond in size and angle with the beveled surfaces of the plate.

7 Claims, 10 Drawing Figures

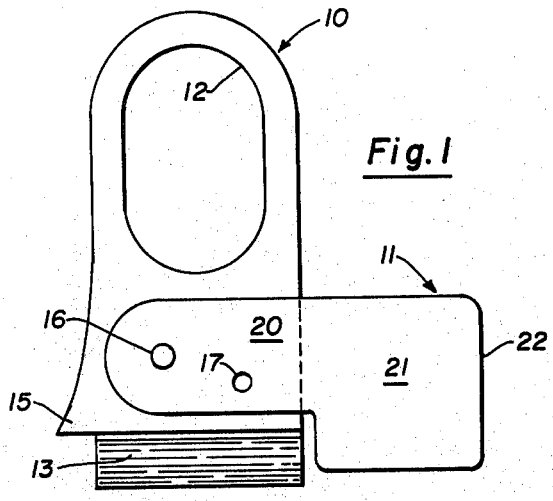
Fig. 1
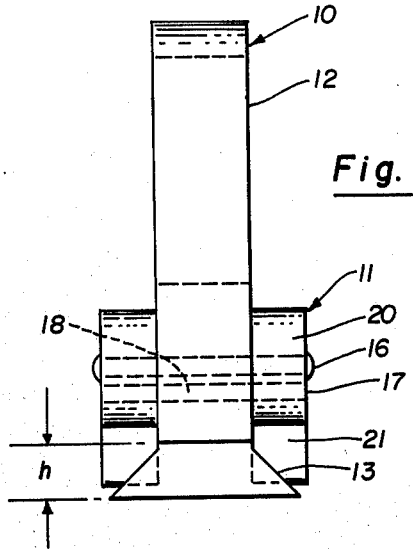
Fig. 2
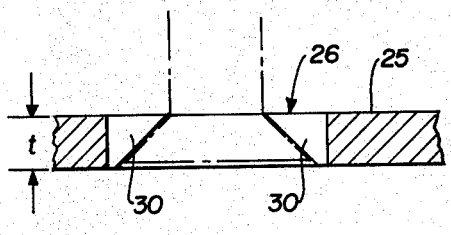
Fig. 4
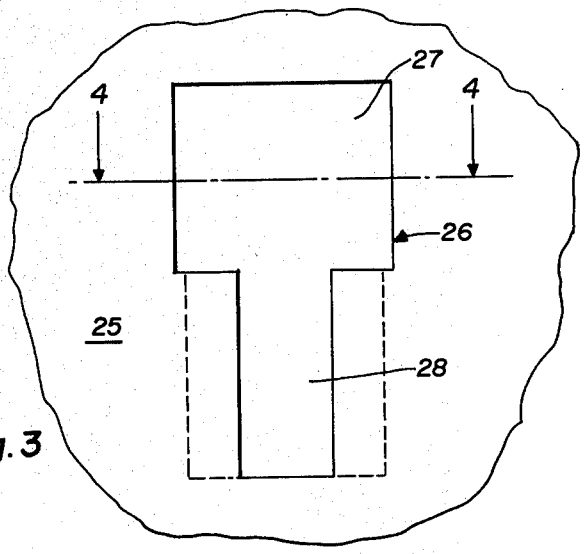
Fig. 3
Fig. 5
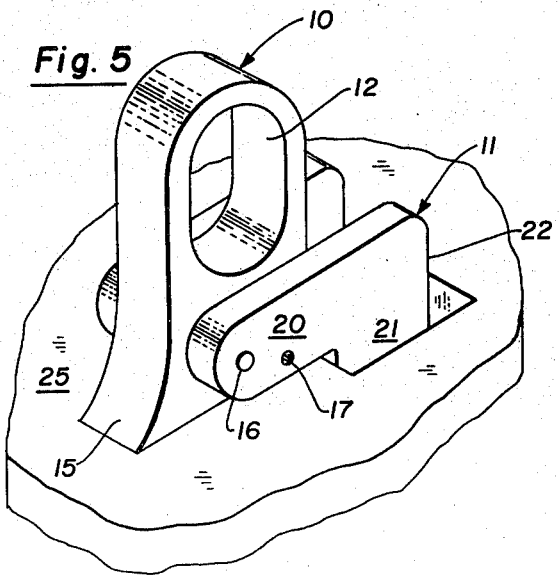
Fig. 6
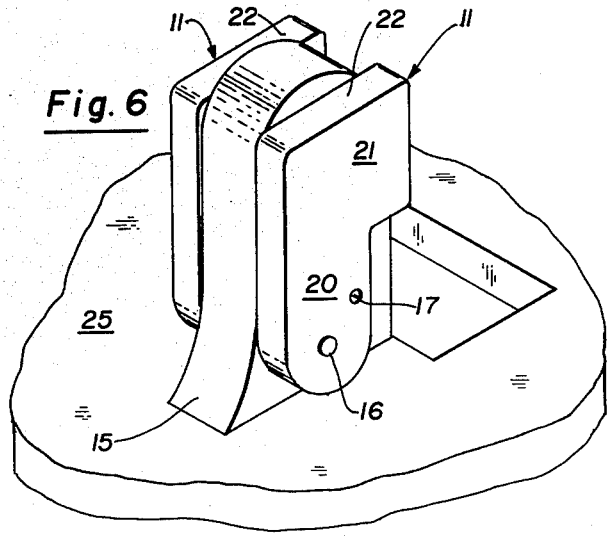

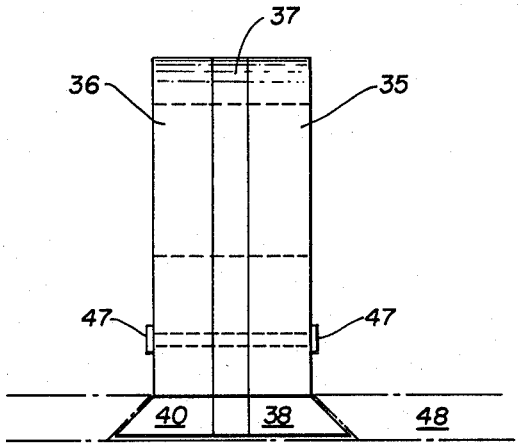
Fig. 9
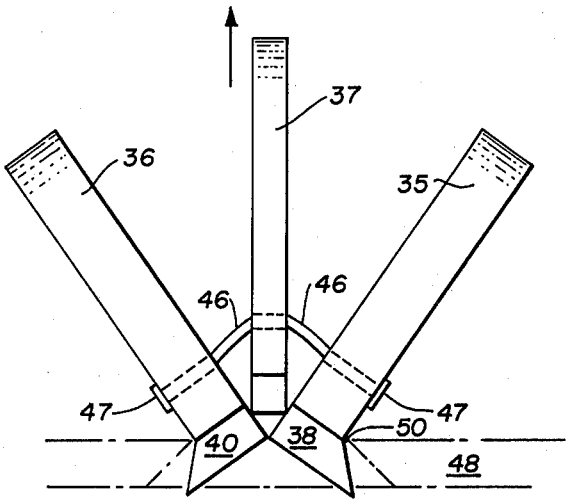
Fig. 10
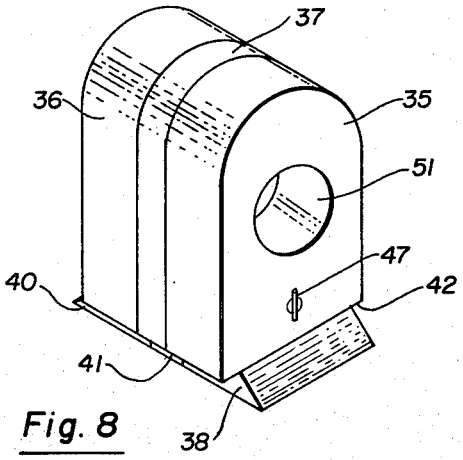
Fig. 8
Fig. 7
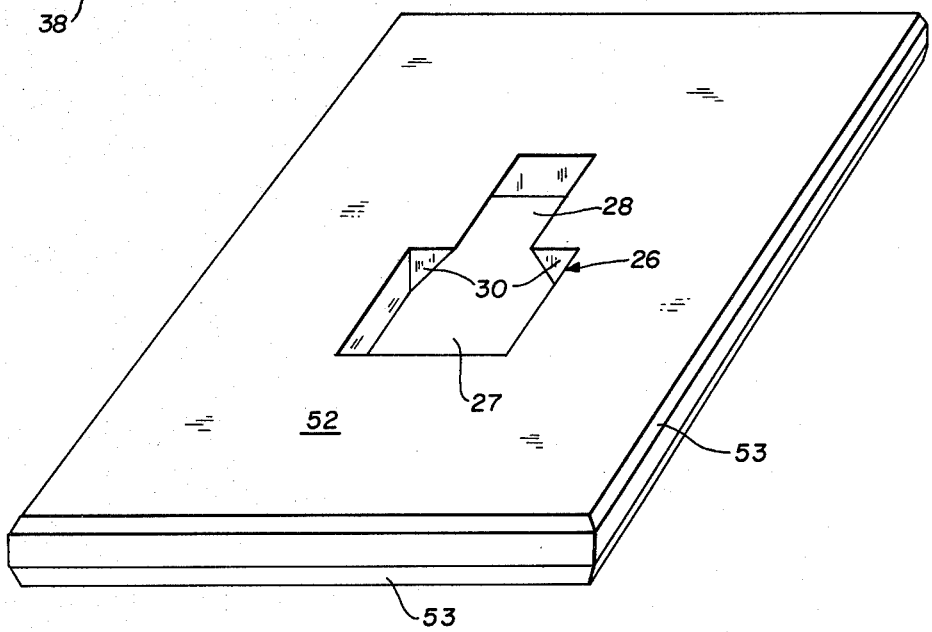

PLATE-LIFTING DEVICE

BACKGROUND OF THE INVENTION

At construction sites or where buried pipes or wires are being repaired, it is frequently necessary to dig trenches or holes which are worked in by construction personnel. Typically, when a utility company is laying or repairing buried pipes or wires, such trenches will be worked in over a number of days. The trenches or holes are generally covered with steel plates when not in use by workmen so that vehicle and pedestrian traffic can proceed without danger.

The plates used to cover such trenches or holes are generally made of steel and are about one inch thick, about 5–7 feet wide, and about 8–10 feet long. These plates weigh thousands of pounds. The usual procedure for putting the plates into place and removing them involves workmen prying up one edge of the plate, for example with a crowbar, placing a block of wood or the like under the pried up edge, then putting a chain through a hole near the edge and placing the workmen's arm beneath the plate to draw the chain through the hole. Only then can a lifting device such as a crane be employed to put force on the chain thereby lifting the plate.

In order to move the plate it must be lifted the distance approximately its maximum dimension because it hangs from a hole in the edge of the plate. Furthermore, the last portion of the plate to leave the ground is generally not on the center of gravity of the plate, and as the plate leaves the ground, it generally swings back and forth and spins. As a result, movement of cover plates is very dangerous. It is dangerous in a first instance because workmen must pry heavy plates from their supporting surface and must reach beneath the plates in order to feed a chain through the lifting hole. This procedure accounts for many crushed feet and hands. Moving the plates is dangerous in the second instance because the heavy plate with sharp corners swings unpredictably about its supporting chain. These swinging plates account for many lacerations and fractures. Finally, movement of plates is dangerous in the third instance because workmen must guide the swinging, asymmetrically-supported plates into position so that they may be lowered into the desired place, and after the plates are in position, the supporting chain must be removed largely by a reverse of the process with which it is attached.

When not in use covering holes or trenches, the steel plates are usually stacked one on top of another. Although this is an effective and space-saving way to store them, it causes another difficulty because it is so difficult to separate one heavy plate stacked upon another when the contacting surfaces are so flat and in such close contact. The use of a crowbar is difficult because there is not adequate room between the plates to provide a secure prying surface.

SUMMARY OF THE INVENTION

This invention provides a device that solves the above-noted problems involved with the use of cover plates. This invention is a plate-lifting device used in conjunction with a plate having a lifting hole including opposed beveled surfaces. The lifting hole is preferably located at the center of gravity of the plate, for example at the intersection of diagonals of a rectangular plate. The beveled portion of the lifting hole, preferably but not necessarily, runs from the bottom surface of the plate to the top surface. Depending on which species of this invention is being used, the lifting hole may require an entry port for the lifting device as will be explained more thoroughly hereinafter.

The lifting device of this invention includes a lifting eye for connecting the device to a crane or other means for providing lifting force, and it is oriented to extend beyond the beveled portions of the device to be described. The lower portion of the lifting eye includes two laterally expanded, opposed beveled portions having bevels at least roughly corresponding in size and angle to the opposed bevels of the lifting hole in the plate with which it is to be used.

The depth of the beveled portions of the lifting device is slightly less than the depth of the plate with which it is to be used, whereby, the device can be used easily to lift a plate stacked on another plate as will be explained more fully hereinafter.

The device of this invention also includes a locking means that holds the beveled surfaces of the lifting device in a position where a lifting force applied to the eye will bring the beveled surfaces of the device into contact with the beveled surfaces of the lifting hole in the plate, but which permits moving the device out of the lifting hole of the plate when the plate is in position, either covering a trench or in storage.

The device of this invention is not a permanent part of the plate. It is used only to move a plate and then it is removed from the plate. For example, if it is necessary to put 15 plates in place in the evening after a work day and to remove those 15 plates and stack them in the morning before work starts, only one device in accordance with this invention is required. In other words, the device is installed in a plate when lifting is to be accomplished, and after the lifting is accomplished, the device is removed from the plate.

As will be explained in conjunction with the description of the drawings, the use of the device of this invention obviates the necessity to pry plates from their supporting surface in order to lift them. It is not necessary to place props beneath the plates, nor is it necessary to have workmen pass chains beneath the plates. When a device in accordance with this invention is used, plates can be moved by lifting them only a few inches, the plates are lifted predictably without swinging about their supporting chain, and they are lifted in a horizontal position.

In another species, the device of this invention may include a plate-lifting device and a plate segment whereby installing the plate segment onto any existing plate converts that existing plate to one that may be used with the device of this invention.

DETAILED DESCRIPTION OF THE INVENTION

This invention may be more clearly defined with reference to the accompanying drawings.

FIG. 1 is a front elevational view of a device embodying this invention.

FIG. 2 is an end view of the device of FIG. 1.

FIG. 3 is a plan view of a portion of a plate cut out to adapt the plate to employ the device of FIG. 1 and FIG. 2.

FIG. 4 is a cross section taken along the line 4—4 of FIG. 3 in the direction of the arrows.

FIG. 5 is a perspective view of the device of FIGS. 1 and 2 installed in a plate and locked into position.

FIG. 6 is perspective view of the device illustrated in FIG. 5 in unlocked position.

FIG. 7 is a plate segment useful as an element of an embodiment of the invention.

FIG. 8 is a perspective view of another device embodying the invention.

FIG. 9 is an elevation view of the device of FIG. 8 in locked position in a plate.

FIG. 10 is an elevation view of the device of FIG. 8 in unlocked position.

The device of this invention illustrated in FIGS. 1, 2, 5 and 6 includes a lifting element generally designated 10, and a locking element generally designated 11. The lifting element is made of thick, strong steel while the locking element may be made of much lighter material in that its function is merely to hold the lifting element in place. The lifting element includes an eye 12 through which a lifting means, such as a cable, chain, clevis, or hook is passed. Near the bottom of the lifting element is a beveled portion 13, the use of which will be described in more detail hereinafter. Also toward the bottom of lifting element 10 is a skirt 15 which serves the function of preventing the lifting element from falling through the hole in the plate with which it is used.

The locking element 11 is connected to the lifting element with a pin 16 about which the locking element 11 can rotate. The locking element also includes a hole 17 which corresponds with a hole 18 so that a locking pin may be passed through holes 17 and 18 to hold the locking element in place in its locking position. The locking element has an arm 20 and an L-shaped end portion 21 having an outer edge 22 that is positioned to contact the edge of the hole in the plate to be lifted.

FIGS. 3 and 4 illustrate the configuration of a hole in a plate that is adapted to receive the lifting device illustrated in FIGS. 1, 2, 5 and 6. The plate is generally designated 25 and it includes a hole generally designated 26. The hole includes a wide front portion 27 and a narrower rear portion 28. The narrow rear portion 28 has a narrow opening on the upper portion of the plate but it is beveled toward the bottom of the plate so that it has as wide an opening on the bottom as the wide portion 27 has. The plate bevels 30 are preferably approximately at the same angle as the lifting device bevel 13. The dimension (h) illustrated in FIG. 2, however, is slightly smaller than the thickness of the plate 25 illustrated as (t) in FIG. 4.

To use the device illustrated in FIGS. 1, 2, 5 and 6, the locking element is first placed in the position shown in FIG. 6 and the beveled portion of the lifting device is placed in the wide front portion of hole 26 with the skirt 15 facing back, or toward the bottom of the drawing in FIG. 3. The beveled portion 13 of the lifting device easily enters the wide portion 27 of the plate. In that position, the lifting device may be moved back or toward the bottom of FIG. 3 so that the beveled portion 13 engages the plate bevels 30. This movement is easy because the dimension (h) in FIG. 2 is slightly smaller than the dimension (t) in FIG. 4 so that the beveled areas may be brought one beneath the other without actually being in contact. When the device is fully to the rear of the hole, the skirt portion 15 lies over the top surface of the plate 25, and the locking device may be rotated around pivot 16 so that the L-shaped end portion 21 is moved into the position illustrated in FIG. 5. In that position, a chain or cable may be passed through the eye 12 and the plate lifted. The lifting device cannot fall through hole 26 because skirt 15 engages the top surface and lifting device 10 cannot slide forward into wide portion 27 because locking device 11 holds it in contact with plate bevels 30. When a lifting force is applied to lifting element 10, the friction between the beveled surfaces 13 and the plate bevels 30 will hold the plate and lifting device in the proper position with respect to one another. Although it is usually not necessary, an added safety feature may be to pass a pin through the hole 17 in the locking element and the hole 18 in the lifting element to ensure that the locking element remains in the locking position shown in FIG. 5. If the hole 28 is at the center of gravity of the plate 25, the plate may be raised in a horizontal position by applying force to the lifting device of this invention, and as such, it need only be lifted a few inches above its supporting surface in order to be moved. It is also important that with a little care, i.e., with the lifting chain approximately vertical when lifting is accomplished, all portions of the plate will leave its supporting surface at the same time and the plate can be lifted without rotating about its center axis and without significant pendulum-type swinging whereby the lifting of a plate may be accomplished very safely. It may also be noted that the device of this invention can be installed in the hole 26 without the need for prying an edge of a plate above its supporting surface and without the need for a workman to put any portion of his body beneath the plate. The plate does not have to be pried from its supporting surface, nor do props have to be placed beneath it in order to install the lifting device. The lifting device of FIGS. 1, 2, 5 and 6 can be readily installed in the plate hole 26 whether the plate is resting on another plate, on the earth, or over a trench. In addition to the safety value of the device of this invention, it is evident that the device of this invention can be installed in a plate much more quickly than previous lifting devices and that the plate, being supported without pendular swinging, without rotating around its supporting chain, and in a horizontal position, can be positioned much more quickly in its desired location than could be done with previous lifting devices.

FIGS. 8, 9 and 10 illustrate another lifting device embodying this invention. FIG. 8 is a perspective view of the device which includes two lifting elements 35 and 36 which are separated by a locking element 37. Each lifting element terminates in a lower beveled portion. Thus, lifting element 35 terminates in beveled portion 38 while lifting element 36 terminates in beveled portion 40. The beveled portions 38 and 40 are shorter from front-to-back as illustrated in FIG. 8 than the lifting portions 35 and 36 thereby producing a forward skirt portion 41 and a rear skirt portion 42. Skirt portions 41 and 42 serve the function of preventing the lifting device illustrated in FIG. 8 from falling through a hole in a plate that is adapted to receive it.

A hole in a plate adapted to receive the device illustrated in FIGS. 8, 9 and 10 need only be that portion of the holes illustrated in FIGS. 3 and 4 that contains the hole bevels 30, and the wide front portion of the hole may be eliminated.

As best illustrated in FIGS. 9 and 10, the lifting elements 35 and 36 and the locking element 37 may be connected together with a resilient element 46 which holds all of the separate parts together but does not prevent them from assuming higher and lower positions with respect to one another. The connection of locking means 37 to lifting elements 35 and 36 through resilient means 46 permits the various elements to move between a position such as illustrated in FIG. 9 and a position such as illustrated in FIG. 10. The resilient means 46, which may be a spring or a rubberband, is connected at each end to a stop 47 so that the various elements are urged toward each other and will normally be in the position illustrated in FIGS. 8 and 9. Thus, only a small force is necessary to move the device into the position illustrated in FIG. 10.

A plate 48 is illustrated in broken lines in FIGS. 9 and 10. In order to use the device illustrated in FIGS. 8, 9 and 10, the device is first placed in a position such as illustrated in FIG. 10 by simply spreading lifting elements 35 and 36, stretching the resilient means 46, and opening the device to a point where the beveled elements 38 and 40 may enter the hole in the plate designated as 50. As best illustrated in FIG. 9, the beveled elements 38 and 40 are not as large from top to bottom as the thickness of the plate 48, and as a consequence, the device of FIGS. 8, 9 and 10 may be placed into position in the hole 50 from the position illustrated in FIG. 10 and finally moved into the position illustrated in FIG. 9 without any portion of the lifting device penetrating the hole 50 as deep as the thickness of plate 48. In the position illustrated in FIG. 9, a suitable lifting means may be passed through the eye 51 and the plate 48 lifted. As with the description of the other drawings, if the hole 50 is at the center of gravity of the plate 48, the plate 48 may be lifted completely off of its supporting surface by being lifted only a few inches, and it can be lifted horizontally, without pendulum-type swinging, and without spinning around the axis of the chain or cable. When the plate 48 is moved to its new position, the lifting device illustrated in FIGS. 8, 9 and 10 may be removed from the hole 50 by simply putting lifting force in the direction of the arrow of FIG. 10 on the locking element 37 and the device slides free of the hole 50, passing through the position illustrated in FIG. 10.

There exists at this time thousands of plates employed to cover trenches that are not adapted with holes to receive the devices of this invention. Such plates could readily be so adapted without the necessity of cutting holes in the plates to the dimensional tolerances required to be employed with the device of this invention. This could be accomplished with a plate segment such as illustrated in FIG. 7 made of the same steel as the plates and having a hole 26 cut at the factory to have the proper size, shape and smoothness to receive the devices of this invention. The plate segment, which is generally designated 52 may be, for example, a square 10 inches on the side or a circle. It may further be adapted with beveled edges 53 to aid in a welding operation. The plate segment 52 could be attached to existing plates in the field with existing field equipment simply by cutting a square hole out of the existing plates at their centers of gravity and welding the plate 52 into that square hole. The bevels 53 could be prepared in the factory to provide a suitable welding groove thereby making the attachment of plate segment 52 even easier. Plate segment 52 could also be attached by being welded to the surface of an existing plate. Plate segments of any size or shape could be employed having holes 26 therein that would adapt an existing plate to whatever species of plate-lifting device is to be used.

What is claimed is:

1. A device for lifting a cover plate having a lifting hole with pyramidal opposed beveled surfaces, said device comprising:

a. a lifting element having an eye and two lower, laterally expanded, pyramidal beveled portions, each of said beveled portions having a depth less than the thickness of said cover plate and a length greater than its depth, and b. locking means movable with respect to said beveled portions connected to said lifting element and having one position with respect to said plate in which the beveled portions of said lifting element are locked in position with respect to the beveled surfaces of said plate in which vertical force applied to said lifting element will bring said beveled portions into engagement with said beveled surfaces.

2. The device of claim 1 wherein said beveled surfaces of said cover plate are adjacent to an expanded hole that is wide enough to admit said beveled portion.

3. The device of claim 2 wherein said locking means is pivoted to rotate in a plane perpendicular to the axis of said eye.

4. The device of claim 1 wherein said locking means lies between two lifting means and is connected between them solely by a resilient means.

5. The device of claim 1 having a laterally expanded skirt portion positioned above said beveled portion.

6. In combination, the device of claim 1 and a plate segment having a lifting hole with opposed beveled surfaces.

7. The device of claim 6 wherein said plate segment has beveled edges.

* * * * *